US010401747B1

(12) United States Patent
Wu

(10) Patent No.: US 10,401,747 B1
(45) Date of Patent: Sep. 3, 2019

(54) UNDERCOAT LAYER FOR IMAGING DEVICE

(71) Applicant: Xerox Corporation, Norwalk, CT (US)

(72) Inventor: Jin Wu, Rochester, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 16/142,402

(22) Filed: Sep. 26, 2018

(51) Int. Cl.
*G03G 5/147* (2006.01)
*G03G 15/00* (2006.01)

(52) U.S. Cl.
CPC ..... *G03G 5/14704* (2013.01); *G03G 5/147* (2013.01); *G03G 5/14708* (2013.01); *G03G 15/75* (2013.01)

(58) Field of Classification Search
CPC ..... G03G 5/14704; G03G 15/75; G03G 5/14708; G03G 5/147
See application file for complete search history.

(56) References Cited

U.S. PATENT DOCUMENTS

| | | | | |
|---|---|---|---|---|
| 4,681,814 | A | 7/1987 | Leidheiser, Jr. et al. | |
| 7,846,628 | B2 | 12/2010 | Wu et al. | |
| 9,939,743 | B2 | 4/2018 | Hoshizaki | |
| 2007/0048639 | A1* | 3/2007 | Wu | G03G 5/047 430/60 |
| 2009/0246660 | A1* | 10/2009 | Wu | G03G 5/0521 430/58.8 |

* cited by examiner

*Primary Examiner* — Thorl Chea
(74) *Attorney, Agent, or Firm* — Hoffman Warnick LLC

(57) ABSTRACT

Described herein is a photoreceptor. The photoreceptor includes a conductive substrate and an undercoat layer disposed on the conductive substrate. The undercoat layer includes a binder resin, metal oxide particles, and a compound selected from the group consisting of: a hydroxyquinoline, an aminoquinoline and a quinoline acid. The photoreceptor include a photosensitive layer disposed on the undercoat layer.

20 Claims, 2 Drawing Sheets

UNDERCOAT LAYER FOR IMAGING DEVICE

BACKGROUND

Field of Use

This disclosure is generally directed to layered imaging members, photoreceptors, photoconductors, and the like including a novel undercoat layer.

Background

Electrostatographic image devices are used in apparatuses such as copying machines and laser beam printers. Electrostatographic photoreceptors used in image forming devices include an organic photoreceptor containing an organic photoconductive material. In general production of the organic photoreceptor, for example, an undercoat layer (also referred to as "intermediate layer") is formed on a conductive substrate, such as an aluminum substrate, and then a photosensitive layer is formed thereon.

Typical undercoat layers include a zinc oxide/hydroxyanthraqinone complex, however, the long-term cyclic stability of the imaging member having such an undercoat layer is marginal.

It would be desirable to improve photoreceptor performance by improving undercoat layer performance.

SUMMARY

Disclosed herein is a photoreceptor. The photoreceptor includes a conductive substrate and an undercoat layer disposed on the conductive substrate. The undercoat layer includes a binder resin, metal oxide particles, and a compound selected from the group consisting of: a hydroxyquinoline, an aminoquinoline and a quinoline acid. The photoreceptor include a photosensitive layer disposed on the undercoat layer.

Additionally, disclosed herein is a photoreceptor. The photoreceptor includes a conductive substrate and an undercoat layer disposed on the conductive substrate. The undercoat layer includes a binder resin, metal oxide particles, and a compound selected from the group consisting of: a hydroxyquinoline, an aminoquinoline and a quinoline acid. The electrostatographic photoreceptor includes a charge generation layer disposed on the undercoat layer and a charge transport layer disposed on the undercoat layer.

Further, disclosed herein is a photoreceptor. The photoreceptor includes a conductive substrate and an undercoat layer disposed on the conductive substrate. The undercoat layer includes a binder resin, metal oxide particles, and a compound selected from the group consisting of: a hydroxyquinoline, an aminoquinoline and a quinoline acid. A photosensitive layer is disposed on the undercoat layer. An anti-curl backing layer is disposed on a surface of a substrate opposite to that bearing the photosensitive layer.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

Figure 1:
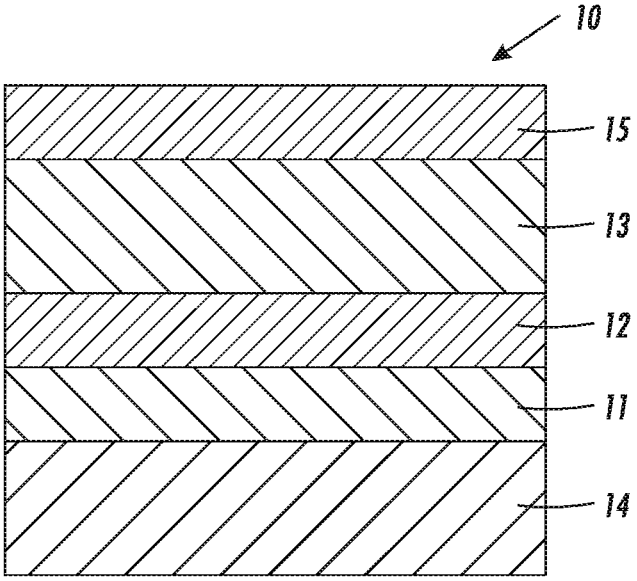
FIG. 1 is a schematic cross-sectional view of an embodiment of a photoreceptor layered structure according to the disclosure provided herein.

It should be noted that some details of the FIGS. have been simplified and are drawn to facilitate understanding of the embodiments rather than to maintain strict structural accuracy, detail, and scale.

DESCRIPTION OF THE EMBODIMENTS

In the following description, reference is made to the chemical formulas that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

As used herein, the term, "electrostatographic," or grammatic versions thereof, is used interchangeably with the terms, "electrophotographic" and "xerographic." The terms, "charge blocking layer" and "blocking layer," are used interchangeably with the terms, "undercoat layer" or "undercoat," or grammatical versions thereof. "Photoreceptor," is used interchangeably with, "photoconductor," "imaging member" or "imaging component," or grammatical versions thereof.

In electrostatographic reproducing or imaging devices, including, for example, a digital copier, an image-on-image copier, a laser printer, a contact electrostatic printing device, a bookmarking device, a facsimile device, a printer, a multifunction device, a scanning device and any other such device, a printed output is provided, whether black and white or color, or a light image of an original is recorded in the form of an electrostatic latent image on an imaging device component, such as, a photoreceptor, which may be present as an integral component of an imaging device or as a replaceable component or module of an imaging device, and that latent image is rendered visible using electroscopic, finely divided, colored or pigmented particles, or toner. The imaging device component or photoreceptor can be used in electrostatographic (xerographic) imaging processes and devices, for example, as a flexible belt or in a rigid drum configuration. Other components may include a flexible intermediate image transfer belt, which can be seamless or seamed.

In electrostatographic image formation, a photoreceptor is charged and then exposed to light for formation of an electrostatic latent image. The exposure of the photoreceptor to light causes the attenuation of the surface potential thereof; in this process, electric charges move at the interface between the photosensitive layer (for example, a charge-generating layer in a functionally-separated photosensitive layer) and the undercoat layer. In the undercoat layer electric charges are transferred.

Figure 2:
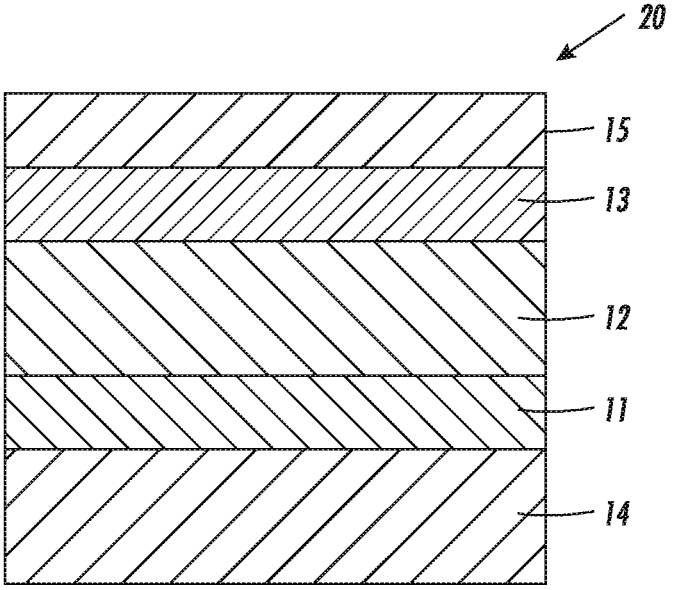
FIG. 2 is a schematic cross-sectional view of an alternate embodiment of a photoreceptor layered structure according to the disclosure provided herein.
Figure 3:
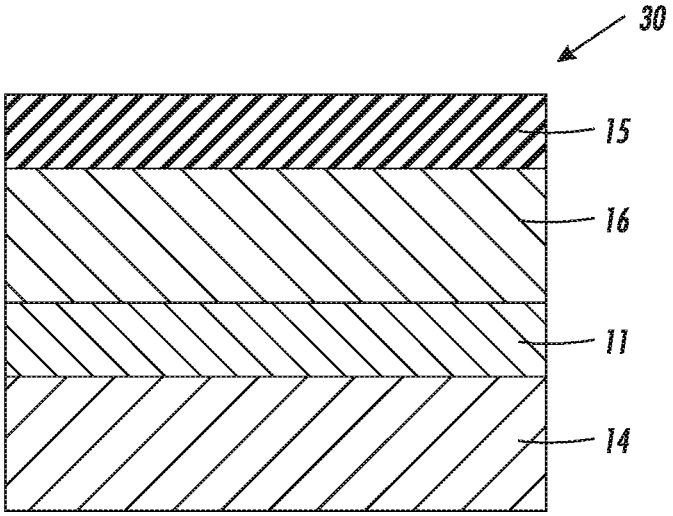
FIG. 3 is a schematic cross-sectional view of an alternate embodiment of a photoreceptor layered structure according to the disclosure provided herein.

FIG. 1 is a schematic cross-sectional view illustrating an embodiment of a photoreceptor. FIGS. 2 and 3 are schematic cross-sectional views illustrating alternate embodiments of photoreceptors.

A photoreceptor 10 illustrated in FIG. 1 is functionally-separated photoreceptor (layered photoreceptor) and includes a conductive substrate 14; an undercoat layer 11 formed thereon; a charge generation layer 12, charge transport layer 13, and overcoat layer 15. The layers disclosed are disposed in sequence so as to overlie the conductive substrate 14 and the undercoat layer 11. In the photoreceptor 10 of FIG. 1, the charge generation layer 12 and the charge transport layer 13 constitute a photosensitive layer.

A photoreceptor 20 illustrated in FIG. 2 is a functionally-separated photoreceptor in which the charge generation layer 12 and the charge transport layer 13 are functionally separated as in the photoreceptor 10 illustrated in FIG. 1. The photoreceptor 20 illustrated in FIG. 2 includes the conductive substrate 14 and the undercoat layer 11 formed thereon. The charge transport layer 13, charge generation layer 12, and overcoat layer 15 are disposed in sequence so as to overlie the conductive substrate 14 and the undercoat layer 11. In the photoreceptor 20, the charge transport layer 13 and the charge generation layer 12 constitute a photosensitive layer. The charge transport layer 13 and the charge generation layer 12 in FIG. 2 are reversed from the sequence shown in FIG. 1.

A photoreceptor 30 is illustrated in FIG. 3. The photoreceptor 30 in FIG. 3 includes a charge generating material and a charge transporting material in a single layer (photosensitive layer 16). The photoreceptor 30 illustrated in FIG. 3 includes the conductive substrate 14, the undercoat layer 11 formed thereon, and the single photosensitive layer 16 disposed so as to overlie the conductive substrate 14 and the undercoat layer 11. An overcoat layer 15 overlies the photosensitive layer 16.

Each layer of the photoreceptor 10 illustrated in FIG. 1, the photoreceptor 20 in FIG. 2 and the photoreceptor 30 in FIG. 3 are described below.

Conductive Substrate (14)

Examples of the conductive substrate 14 include metal plates, metal drums, and metal belts containing metals (such as aluminum, copper, zinc, chromium, nickel, molybdenum, vanadium, indium, gold, and platinum) or alloys (such as stainless steel). Other examples of the conductive substrate include paper, resin films, and belts each having a coating film formed by applying, depositing, or laminating conductive compounds (such as conductive polymers and indium oxide), metals (such as aluminum, palladium, and gold), or alloys. The term "conductive" herein refers to having a volume resistivity that is less than $10^{13}$ Ωcm.

The conductive substrate 14 may be flexible or rigid and may have any of a number of different configurations, such as, for example, a sheet, a scroll, an endless flexible belt, a web, a cylinder, and the like.

The thickness of the conductive substrate depends on numerous factors, including the required mechanical performance and economic considerations. The thickness of the conductive substrate 14 is typically within a range of from about 65 micrometers to about 150 micrometers, such as from about 75 micrometers to about 125 micrometers for optimum flexibility and minimum induced surface bending stress when cycled around small diameter rollers, e.g., 19 mm diameter rollers. The conductive substrate 14 for a flexible belt may be of substantial thickness, for example, over 200 micrometers, or of minimum thickness, for example, less than 50 micrometers, provided there are no adverse effects on the final photoconductive device. Where a drum is used, the thickness should be sufficient to provide the necessary rigidity. This is usually about 1-6 mm.

The surface of the conductive substrate 14 to which other layers may be applied may be cleaned to promote greater adhesion of such layers. Cleaning may be effected, for example, by exposing the surface of the substrate layer to plasma discharge, ion bombardment, and the like. Other methods, such as solvent cleaning, may also be used.

Charge Generation Layer (12)

Illustrative organic photoconductive charge generating materials include azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments such as benzimidazole perylene; indigo pigments such as indigo, thioindigo, and the like; bisbenzoimidazole pigments such as Indofast Orange, and the like; phthalocyanine pigments such as copper phthalocyanine, aluminochloro-phthalocyanine, hydroxygallium phthalocyanine, chlorogallium phthalocyanine, titanyl phthalocyanine and the like; quinacridone pigments; or azulene compounds. Suitable inorganic photoconductive charge generating materials include for example cadium sulfide, cadmium sulfoselenide, cadmium selenide, crystalline and amorphous selenium, lead oxide and other chalcogenides. In embodiments, alloys of selenium may be used and include for instance selenium-arsenic, selenium-tellurium-arsenic, and selenium-tellurium.

Any suitable inactive resin binder material may be employed in the charge generating layer 14. Typical organic resinous binders include polycarbonates, acrylate polymers, methacrylate polymers, vinyl polymers, cellulose polymers, polyesters, polysiloxanes, polyamides, polyurethanes, epoxies, polyvinylacetals, and the like.

To create a dispersion useful as a coating composition, a solvent is used with the charge generating material. The solvent may be for example cyclohexanone, methyl ethyl ketone, tetrahydrofuran, alkyl acetate, and mixtures thereof. The alkyl acetate (such as butyl acetate and amyl acetate) can have from 3 to 5 carbon atoms in the alkyl group. The amount of solvent in the composition ranges for example from about 70% to about 98% by weight, based on the weight of the composition.

The amount of the charge generating material in the composition ranges for example from about 0.5% to about 30% by weight, based on the weight of the composition including a solvent. The amount of photoconductive particles (i.e., the charge generating material) dispersed in a dried photoconductive coating varies to some extent with the specific photoconductive pigment particles selected. For example, when phthalocyanine organic pigments such as titanyl phthalocyanine and metal-free phthalocyanine are utilized, satisfactory results are achieved when the dried photoconductive coating comprises between about 30 percent by weight and about 90 percent by weight of all phthalocyanine pigments based on the total weight of the dried photoconductive coating. Because the photoconductive characteristics are affected by the relative amount of pigment per square centimeter coated, a lower pigment loading may be utilized if the dried photoconductive coating layer is thicker. Conversely, higher pigment loadings are desirable where the dried photoconductive layer is to be thinner.

Generally, satisfactory results are achieved with an average photoconductive particle size of less than about 0.6 micrometer when the photoconductive coating is applied by dip coating. The average photoconductive particle size may be less than about 0.4 micrometer. In embodiments, the photoconductive particle size is also less than the thickness of the dried photoconductive coating in which it is dispersed.

In a charge generation layer 12, the weight ratio of the charge generating material ("CGM") to the binder ranges from 30 (CGM):70 (binder) to 70 (CGM):30 (binder).

For multilayered photoreceptors comprising a charge generation layer 12 and a charge transport layer 13, satisfactory results may be achieved with a dried photoconductive layer coating thickness of between about 0.1 micrometer and about 10 micrometers. In embodiments, the photoconductive layer thickness is between about 0.2 micrometer and about 4 micrometers. However, these thicknesses also depend upon the pigment loading. Thus, higher pigment loadings permit the use of thinner photoconductive coatings. Thicknesses outside these ranges may be selected providing the objectives of the present invention are achieved.

Any suitable technique may be utilized to disperse the photoconductive particles in the binder and solvent of the coating composition. Typical dispersion techniques include, for example, ball milling, roll milling, milling in vertical attritors, sand milling, and the like. Typical milling times using a ball roll mill is between about 4 and about 6 days.

Charge transport materials include an organic polymer, a non-polymeric material, or a structured organic film (SOF), which may be a composite and/or capped SOF, capable of supporting the injection of photoexcited holes or transporting electrons from the photoconductive material and allowing the transport of these holes or electrons through the organic layer to selectively dissipate a surface charge.

Charge Transport Layer (13)

Additional charge transport materials include for example a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and hydrazone compounds. Typical hole transport materials include electron donor materials, such as carbazole; N-ethyl carbazole; N-isopropyl carbazole; N-phenyl carbazole; tetraphenylpyrene; 1-methylpyrene; perylene; chrysene; anthracene; tetraphene; 2-phenyl naphthalene; azopyrene; 1-ethyl pyrene; acetyl pyrene; 2,3-benzochrysene; 2,4-benzopyrene; 1,4-bromopyrene; poly(N-vinylcarbazole); poly(vinylpyrene); poly(vinyltetraphene); poly(vinyltetracene) and poly(vinylperylene). Suitable electron transport materials include electron acceptors such as 2,4,7-trinitro-9-fluorenone; 2,4,5,7-tetranitro-fluorenone; dinitroanthracene; dinitroacridene; tetracyanopyrene; dinitroanthraquinone; and butylcarbonylfluorenemalononitrile, see U.S. Pat. No. 4,921,769 the disclosure of which is incorporated herein by reference in its entirety. Other hole transporting materials include arylamines described in U.S. Pat. No. 4,265,990 the disclosure of which is incorporated herein by reference in its entirety, such as N,N'-diphenyl-N,N'-bis(alkylphenyl)-(1,1'-biphenyl)-4,4'-diamine wherein alkyl is selected from the group consisting of methyl, ethyl, propyl, butyl, hexyl, and the like. Other known charge transport layer molecules may be selected, reference for example U.S. Pat. Nos. 4,921,773 and 4,464,450 the disclosures of which are incorporated herein by reference in their entireties.

Any suitable technique may be utilized to apply the charge transport layer and the charge generating layer to the substrate. Typical coating techniques include dip coating, roll coating, spray coating, rotary atomizers, and the like. The coating techniques may use a wide concentration of solids. The solids content is between about 2 percent by weight and 30 percent by weight based on the total weight of the dispersion. The expression "solids" refers, for example, to the charge transport particles and binder components of the charge transport coating dispersion. These solids concentrations are useful in dip coating, roll, spray coating, and the like. Generally, a more concentrated coating dispersion may be used for roll coating. Drying of the deposited coating may be effected by any suitable conventional technique such as oven drying, infra-red radiation drying, air drying and the like. Generally, the thickness of the transport layer is between about 5 micrometers to about 100 micrometers, but thicknesses outside these ranges can also be used. In general, the ratio of the thickness of the charge transport layer to the charge generating layer is maintained, for example, from about 2:1 to 200:1 and in some instances as great as about 400:1.

Single Photosensitive Layer (16)

A photosensitive layer 16 (charge-generating/charge-transporting layer, embodied in FIG. 3) is, for example, a layer containing a charge-generating material, a charge-transporting material, and optionally a binder resin and another known additive. These materials are the same as those materials used for forming the charge-generating layer and the charge-transporting layer.

The amount of the charge-generating material contained in the single photosensitive layer is suitably from 10 weight % to 85 weight %, and preferably from 20 weight % to 50 weight % relative to the total solid content. The amount of the charge-transporting material contained in the single photosensitive layer is suitably from 5 weight % to 50 weight % relative to the total solid content.

The photosensitive layer 16 is formed by the same technique as those for forming the charge generation layer 12 and the charge transport layer 13.

The thickness of the single photosensitive layer 16 is, for instance, suitably from 5 microns to 50 microns, or in embodiments from 10 microns to 40 microns.

Overcoat Layer (15)

An overcoat layer 15 is optionally formed on the photosensitive layer. The overcoat layer 15 is formed, for instance, in order to prevent the photosensitive layer from being chemically changed in the charging and to improve the mechanical strength of the photosensitive layer. The overcoat layer is properly a layer of a cured film (crosslinked film). The thickness of the protective layer is, for instance, adjusted to be preferably from 1 micron to 20 microns, and more preferably from 2 microns to 10 microns.

In embodiments, the overcoat layer 15 may have a thickness ranging from about 1 micron to about 25 microns or from about 1 micron to about 10 microns, or in a specific embodiment, about 3 microns to about 10 microns. The overcoat layer may include a charge transport component and an optional organic polymer or inorganic polymer. These overcoat layer may include thermoplastic organic polymers or cross-linked polymers such as thermosetting resins, UV or e-beam cured resins, and the likes.

The overcoat layer 15 may further include a particulate additive such as metal oxides including aluminum oxide and silica, or low surface energy polytetrafluoroethylene (PTFE), and combinations thereof. Any known or new overcoat materials may be included for the present embodiments. In embodiments, the overcoat layer may include a charge transport component or a cross-linked charge transport component. In particular embodiments, for example, the overcoat layer comprises a charge transport component comprised of a tertiary arylamine containing substituent capable of self cross-linking or reacting with the polymer resin to form a cured composition.

In embodiments, the overcoat layer may comprise structured organic films (SOFs) that are electrically insulating or slightly semi-conductive. Such overcoat includes a structured organic film forming reaction mixture containing a plurality of molecular building blocks that optionally contain charge transport segments as described in U.S. Pat. No. 8,372,566 incorporated by reference in its entirety.

Additives may be present in the overcoat layer 15 in the range of about 0.5 to about 40 weight percent of the overcoat layer 15. In embodiments, additives include organic and inorganic particles which can further improve the wear resistance and/or provide charge relaxation property. In embodiments, organic particles include Teflon powder, carbon black, and graphite particles. In embodiments, inorganic particles include insulating and semiconducting metal oxide particles such as silica, zinc oxide, tin oxide and the like. Another semiconducting additive is the oxidized oligomer salts as described in U.S. Pat. No. 5,853,906 the disclosure of which is incorporated herein by reference in its entirety. In embodiments, oligomer salts are oxidized N,N,N',N'-tetra-p-tolyl-4,4'-biphenyldiamine salt.

Undercoat Layer (11)

In embodiments, the undercoat layer 11 contains a binder resin, a metal oxide, and a compound selected from the group consisting of: an hydroxyquinolone, a aminoquinoline and a quinolone acid.

In embodiments, the binder resin used in the undercoat layer 11 include known polymer binders such as acetal resins (e.g., polyvinyl butyral), polyvinyl alcohol resins, polyvinyl acetal resins, casein resins, polyamide resins, cellulose resins, gelatin, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenolic resins, phenol-formaldehyde resins, melamine resins, urethane resins, alkyd resins, and epoxy resins; zirconium chelate compounds; titanium chelate compounds; aluminum chelate compounds; titanium alkoxide compounds; organic titanium compounds; and known materials such as silane coupling agents. Other examples of the binder resin used in the undercoat layer 11 include charge-transporting resins having charge-transporting groups and conductive resins (e.g., polyaniline).

The binder resin used for forming the undercoat layer is suitably insoluble in a solvent used to form the photosensitive layer (12 and 13 in FIGS. 1 and 2 or 16 in FIG. 3), or the overcoat layer. In particular, suitable resins are thermosetting resins, such as polyurethanes, urea resins, phenolic resins, phenol-formaldehyde resins, melamine resins, urethane resins, unsaturated polyester resins, alkyd resins, and epoxy resins, and resins produced through the reaction of a curing agent with at least one resin selected from the group consisting of polyamide resins, polyester resins, polyether resins, methacrylic resins, acrylic resins, polyvinyl alcohol resins, and polyvinyl acetal resins.

Metal oxide particles suitable for use in the undercoat layer 11 include metal oxide particles having a powder resistance (volume resistivity) ranging from $10^2$ Ωcm to $10^{11}$ Ωcm.

Specific examples of the metal oxide particles having such a resistance include tin oxide particles, titanium oxide particles, zinc oxide particles, and zirconium oxide particles. In embodiments, the metal oxide particles are selected from the group consisting of zinc oxide particles and titanium oxide particles. The metal oxide particles may be used alone or in combination.

The average primary particle size of the metal oxide particles is suitably 500 nm or less; or in embodiments in the range of 20 nm to 200 nm, or in embodiments from 30 nm to 150 nm, or in embodiments from 30 nm to 100 nm.

The metal oxide particle content is, for example, in the range of 10 weight % to 80 weight %, or from 40 weight % to 80 weight % relative to the weight of binder resin in the undercoat layer 11. The metal oxide particles may be optionally subjected to a surface treatment.

In embodiments, the hydroxyquinoline can include 8-hydroxyquinoline, 2-hydroxy-4-methylquinoline, isocarbostyril, 8-hydroxyquinoline-5-sulfonic acid, 8-(trifluoromethyl)quinolin-4-ol, 3-hydroxyisoquinoline, 4-hydroxyquinoline, 3-hydroxy-2-methyl-4-quinolinecarboxylic acid, 2-hydroxy-4-quinolincarboxylic acid, 4-hydroxy-6,7-dimethoxyqunioline, 5,7-dichloro-8-hydroxyquinaldine, 6-bromo-4-hydroxyquinoline, 7-methoxy-4-quinolinol, 5-hydroxyquinoline, 2,6-dihydroxyquinoline, 8-fluoro-4-hydroxyquinoline, 7-hydroxyisoquinoline, 8-hydroxyquinaldine, 2,3-dihydroxyquinoxaline, xanthurenic acid. The following structures respectively represent the hydroxyquinolines listed above:

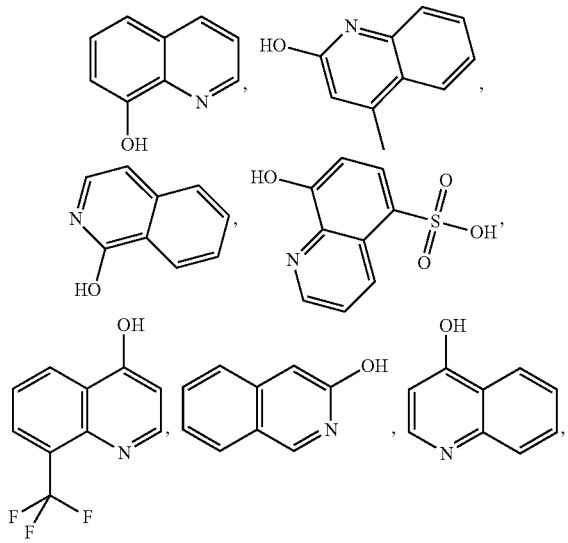

-continued

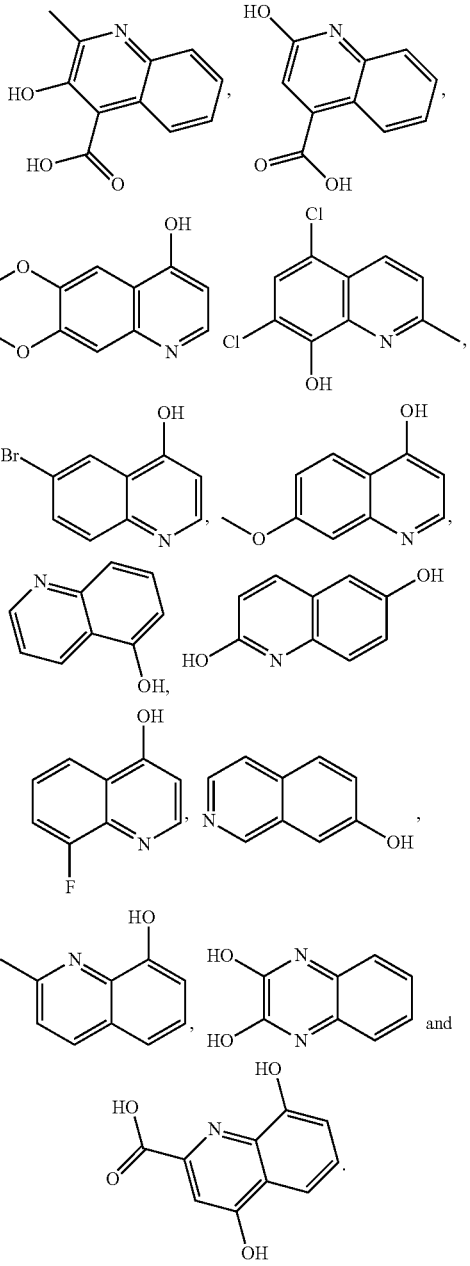

In embodiments the aminoquinoline used in the undercoat layer includes quinolin-2-amine, 8-aminoisoquinoline, 6-aminoquinoxaline, 8-aminoquinaldine, 2-hydrazinoquinoline, 4-amino-2-methylquinoline, 8-aminoquinoline, 5-aminoquinoline, 6-aminoquinoline, 3-aminoquinoline, 4-aminoguinoline, 1-aminoisoquinoline and 6-amino-2-methylquinoline. The following structures respectively represent the aminoquinolines listed above:

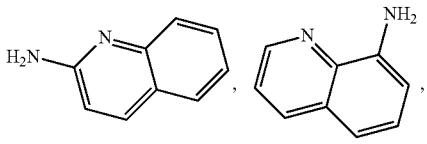

-continued

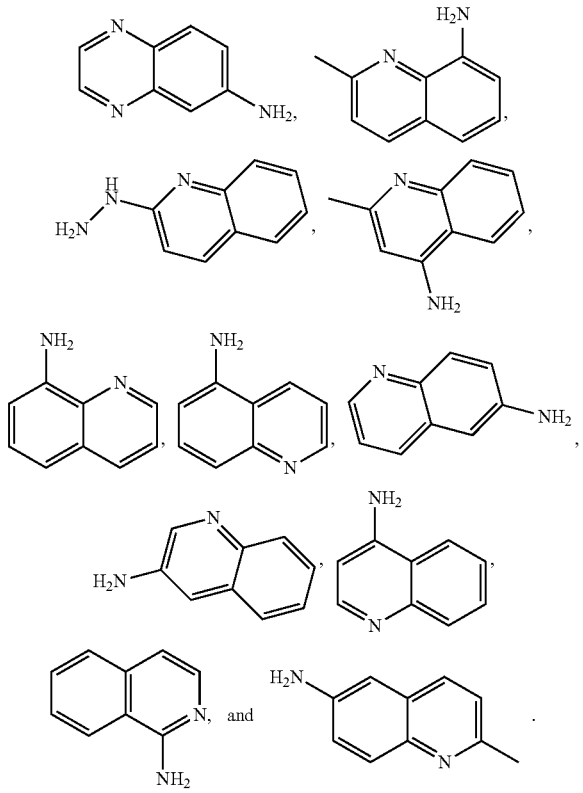

In embodiments the quinoline acid used in the undercoat layer 11 includes 8-quinolineboronic acid, 2-methyl-6-quinolinecarboxylic acid, quinoline-4-carboxylic acid, 6-quinolinecarboxylic acid, 8-quinolinecarboxylic acid, 3-quinolinecarboxylic acid, 2-chloroquinoline-4-carboxylic acid, 3-quinolineboronic acid, quinaldic acid, 5-isoquinolinesulfonic acid, quinoline-8-sulfonic acid, isoquinoline-1-carboxylic acid, 2-chloro-3-quinolinecarboxylic acid, 7-quinolinecarboxylic acid, quinoline-2,4-dicarboxylic acid and 2-methyl-quinoline-4-carboxylic acid. The following structures respectively represent the quinoline acids listed above:

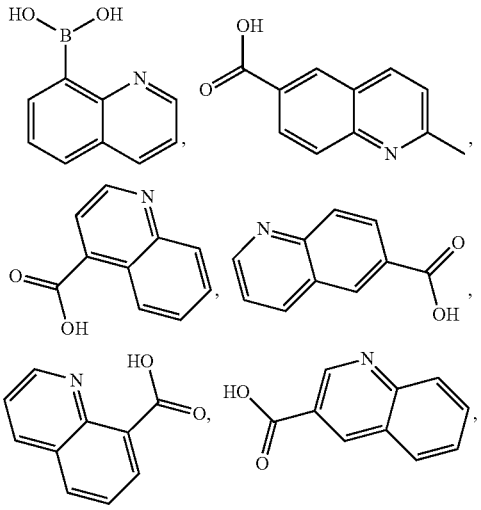

-continued

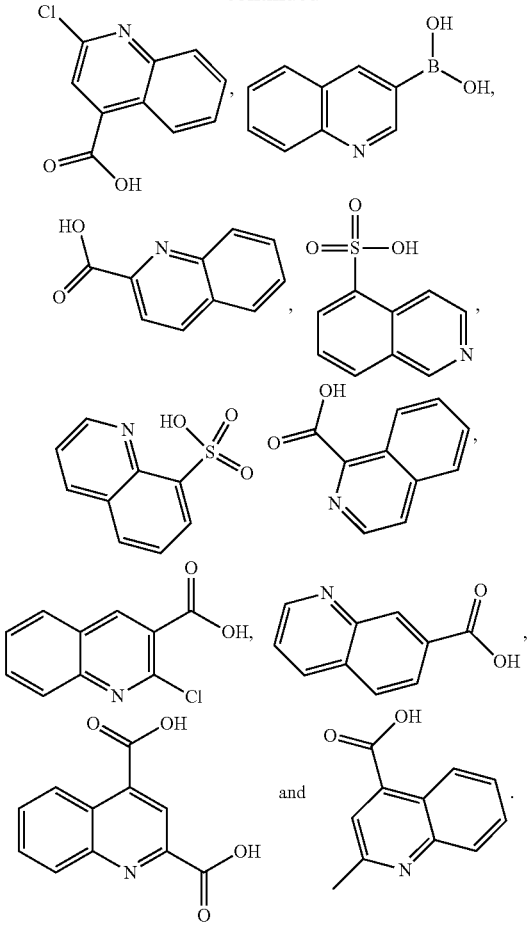

Although not illustrated, optional layers may be provided in the photoreceptors shown in FIGS. 1-3. Example of optional layers include an intermediate layer, an adhesive layer or an anti-curl back coating layer.

Intermediate Layer

Examples of the resin used for forming the intermediate layer include known polymer compounds such as acetal resins (e.g., polyvinyl butyral), polyvinyl alcohol resins, polyvinyl acetal resins, casein resins, polyamide resins, cellulose resins, gelatine, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer containing an organic metal compound. Examples of the organic metal compound used for forming the intermediate layer include organic metal compounds containing metal atoms of zirconium, titanium, aluminum, manganese, or silicon.

The compounds used for forming the intermediate layer may be used alone or in the form of a mixture or polycondensate of multiple compounds. In particular, the intermediate layer is suitably a layer containing an organic metal compound that contains a zirconium atom or a silicon atom.

Adhesive Layer

An optional adhesive interface layer may be employed. An adhesive layer may be situated, for example, intermediate between the undercoat layer 11 and the charge generation layer 12. The adhesive layer may include a film-forming material, such as, a polyurethane, a polyester and so on. An example of a polyester includes a polyarylate, a polyvinylbutyral and the like.

Any suitable solvent or solvent mixture may be employed to form an adhesive layer coating solution. Typical solvents include tetrahydrofuran, toluene, monochlorobenzene, methylene chloride, cyclohexanone and the like, as well as mixtures thereof. Any suitable and conventional technique may be used to mix and thereafter to apply the adhesive interface layer coating mixture to the photoreceptor under construction as taught herein or as known in the art. Typical application techniques include spraying, dip coating, roll coating, wire wound rod coating and the like. Drying of the deposited wet coating may be accomplished by any suitable conventional process, such as oven drying, infrared drying, air drying and the like.

The adhesive layer may have a thickness of from about 0.01 μm to about 900 μm after drying. In certain embodiments, the dried thickness is from about 0.03 μm to about 1 μm.

Anti-Curl Back Coating Layer

An anti-curl back coating may be applied to the surface of a substrate opposite to that bearing the photoconductive layer(s) to provide flatness and/or abrasion resistance, such as, when a web configuration imaging device component is contemplated. The anti-curl back coating layer is known and can comprise a film-forming material or binder, such as, thermoplastic organic polymers or inorganic polymers, that are electrically insulating or slightly semi-conductive. The thickness of anti-curl back coating layers generally is sufficient to balance substantially the total forces of the layer or layers on the opposite side of a substrate. An example of an anti-curl back coating layer is described in U.S. Pat. No. 4,654,284, the disclosure of which is incorporated herein by reference in entirety. A thickness of from about 70 μm to about 160 μm can be used for a flexible device imaging component, although the thickness can be outside that range as a design choice.

Because conventional anti-curl back coating formulations can suffer from electrostatic charge build up due to contact friction between the anti-curl back coating layer and, for example, backer bars, which can increase friction and wear, incorporation of compounds to dissipate charge, such as, nanopolymeric gel particles, into the anti-curl back coating layer can substantially eliminate charge build up. In addition to reducing electrostatic charge build up and reducing wear in the layer, a charge dissipating material, such as, nanopolymeric gel particles, may be used to enhance lubricity, scratch resistance and wear resistance of the anti-curl back coating layer. In some embodiments, the nanopolymeric gel particles are comprised of crosslinked polystyrene-n-butyl acrylate, which are dispersed or embedded in a film-forming material or binder, such as, a polymer or a matrix.

In some embodiments, the anti-curl back coating layer may comprise a charge transport molecule or component. The charge transport molecule may be present from about 1% to about 60% by weight of the total weight of the anti-curl back coating layer.

Various aspects of the embodiments of interest now will be exemplified in the following non-limiting examples. While embodiments have been illustrated with respect to one or more implementations, alterations and/or modifications can be made to the illustrated examples without departing from the spirit and scope of the appended claims. In addition, while a particular feature herein may have been disclosed with respect to only one of several implementations, such feature may be combined with one or more other features of the other implementations as may be desired and advantageous for any given or particular function.

EXAMPLES

Example 1

Zinc oxide (average particle diameter: 70 nm, produced by Tayca Corporation, specific surface area: 15 $m^2/g$) in an amount of 100 parts by weight is mixed and stirred with 500 parts by weight of tetrahydrofuran, and 1.3 parts by weight of a silane coupling agent (KBM503 produced by Shin-Etsu Chemical Co., Ltd.) is added to the resulting mixture, followed by stirring for 2 hours. Then tetrahydrofuran is distilled away at a reduced pressure, and baking is conducted at 120° C. for 3 hours. As a result, zinc oxide surface-treated with a silane coupling agent is obtained.

The surface-treated zinc oxide in an amount of 110 parts by weight is mixed and stirred with 500 parts by weight of tetrahydrofuran. A solution prepared by dissolving 0.6 part by weight of 8-hydroxyquinoline in 50 parts by weight of tetrahydrofuran is added to the resulting mixture, followed by stirring at 50° C. for 5 hours. The 8-hydroxyquinoline-added zinc oxide is filtered out by vacuum filtration and dried at 60° C. at a reduced pressure. As a result, 8-hydroxyquinoline-added zinc oxide is obtained.

A solution is prepared by mixing/dissolving 60 parts by weight of the 8-hydroxyquinoline-added zinc oxide, 13.5 parts by weight of a curing agent (blocked isocyanate, Sumidur 3175 produced by Sumitomo Bayer Urethane Co., Ltd.), and 15 parts by weight of butyral resin (S-LEC BM-1 produced by Sekisui Chemical Co., Ltd.) in 85 parts by weight of methyl ethyl ketone, and 38 parts by weight of this solution is mixed with 25 parts by weight of methyl ethyl ketone. The resulting mixture is dispersed for 2 hours in a sand mill using glass beads 1 mm in diameter to obtain a dispersion.

To the dispersion, 0.005 part by weight of dioctyltin dilaurate and 40 parts by weight of silicone resin particles (Tospearl 145 produced by Momentive Performance Materials Inc.) are added to obtain a coating solution for forming an undercoat layer. The coating solution is applied to an aluminum base having a diameter of 60 mm, a length of 357 mm, and a thickness of 1 mm by a dip coating technique and cured by drying at 170° C. for 40 minutes. As a result, an undercoat layer having a thickness of 19 microns is obtained.

Example 2

EXAMPLE 2 is prepared similarly as EXAMPLE 1, except that 8-hydroxyquinoline is replaced with 8-aminoquinoline.

Example 3

EXAMPLE 3 is prepared similarly as EXAMPLE 1, except that 8-hydroxyquinoline is replaced with 8-quinolinecarboxylic acid.

It will be appreciated that variants of the above-disclosed and other features and functions or alternatives thereof, may be combined into other different systems or applications. Various presently unforeseen or unanticipated alternatives, modifications, variations, or improvements therein may be subsequently made by those skilled in the art which are also encompassed by the following claims.

What is claimed is:

1. A photoreceptor comprising:

a conductive substrate;

an undercoat layer disposed on the conductive substrate, the undercoat layer including a binder resin, metal oxide particles, and a compound selected from the group consisting of: a hydroxyquinoline, an aminoquinoline and a quinoline acid; and a photosensitive layer disposed on the undercoat layer.

2. The photoreceptor according to claim 1, wherein the metal oxide particles are selected from the group consisting of: tin oxide particles, titanium oxide particles, zinc oxide particles, and zirconium oxide particles.

3. The photoreceptor according to claim 1, further comprising an overcoat layer disposed on the photosensitive layer.

4. The photoreceptor according to claim 1, wherein the hydroxyquinoline is selected from the group consisting of: 8-hydroxyquinoline, 2-hydroxy-4-methylquinoline, isocarbostyril, 8-hydroxyquinoline-5-sulfonic acid, 8-(trifluoromethyl)quinolin-4-ol, 3-hydroxyisoquinoline, 4-hydroxyquinoline, 3-hydroxy-2-methyl-4-quinolinecarboxylic acid, 2-hydroxy-4-quinolincarboxylic acid, 4-hydroxy-6,7-dimethoxyqunioline, 5,7-dichloro-8-hydroxyquinaldine, 6-bromo-4-hydroxyquinoline, 7-methoxy-4-quinolinol, 5-hydroxyquinoline, 2,6-dihydroxyquinoline, 8-fluoro-4-hydroxyquinoline, 7-hydroxyisoquinoline, 8-hydroxyquinaldine, 2,3-dihydroxyquinoxaline and xanthurenic acid.

5. The photoreceptor according to claim 1, wherein the aminoquinoline is selected from the group consisting of: quinolin-2-amine, 8-aminoisoquinoline, 6-aminoquinoxaline, 8-aminoquinaldine, 2-hydrazinoquinoline, 4-amino-2-methylquinoline, 8-aminoquinoline, 5-aminoquinoline, 6-aminoquinoline, 3-aminoquinoline, 4-aminoguinoline, 1-aminoisoquinoline and 6-amino-2-methylquinoline.

6. The photoreceptor according to claim 1, wherein the quinoline acid is selected from the group consisting of: 8-quinolineboronic acid, 2-methyl-6-quinolinecarboxylic acid, quinoline-4-carboxylic acid, 6-quinolinecarboxylic acid, 8-quinolinecarboxylic acid, 3-quinolinecarboxylic acid, 2-chloroquinoline-4-carboxylic acid, 3-quinolineboronic acid, quinaldic acid, 5-isoquinolinesulfonic acid, quinoline-8-sulfonic acid, isoquinoline-1-carboxylic acid, 2-chloro-3-quinolinecarboxylic acid, 7-quinolinecarboxylic acid, quinoline-2,4-dicarboxylic acid and 2-methyl-quinoline-4-carboxylic acid.

7. The photoreceptor according to claim 1, wherein the metal oxide particle content in the undercoat layer is from about 10 weight percent to about 80 weight percent relative to the weight of binder resin.

8. A photoreceptor comprising:

a conductive substrate;

an undercoat layer disposed on the conductive substrate, the undercoat layer including a binder resin, metal oxide particles, and a compound selected from the group consisting of: a hydroxyquinoline, an aminoquinoline and a quinoline acid;

a charge generation layer disposed on the undercoat layer; and a charge transport layer disposed on the undercoat layer.

9. The photoreceptor according to claim 8, wherein the metal oxide particles are selected from the group consisting of: tin oxide particles, titanium oxide particles, zinc oxide particles, and zirconium oxide particles.

10. The photoreceptor according to claim 8, further comprising an overcoat layer disposed on the photosensitive layer.

11. The photoreceptor according to claim 8, wherein the hydroxyquinoline is selected from the group consisting of: 8-hydroxyquinoline, 2-hydroxy-4-methylquinoline, isocarbostyril, 8-hydroxyquinoline-5-sulfonic acid, 8-(trifluoromethyl)quinolin-4-ol, 3-hydroxyisoquinoline, 4-hydroxyquinoline, 3-hydroxy-2-methyl-4-quinolinecarboxylic acid, 2-hydroxy-4-quinolincarboxylic acid, 4-hydroxy-6,7-dimethoxyqunioline, 5,7-dichloro-8-hydroxyquinaldine, 6-bromo-4-hydroxyquinoline, 7-methoxy-4-quinolinol, 5-hydroxyquinoline, 2,6-dihydroxyquinoline, 8-fluoro-4-hydroxyquinoline, 7-hydroxyisoquinoline, 8-hydroxyquinaldine, 2,3-dihydroxyquinoxaline and xanthurenic acid.

12. The photoreceptor according to claim 8, wherein the aminoquinoline is selected from the group consisting of: quinolin-2-amine, 8-aminoisoquinoline, 6-aminoquinoxaline, 8-aminoquinaldine, 2-hydrazinoquinoline, 4-amino-2-methylquinoline, 8-aminoquinoline, 5-aminoquinoline, 6-aminoquinoline, 3-aminoquinoline, 4-aminoguinoline, 1-aminoisoquinoline and 6-amino-2-methylquinoline.

13. The photoreceptor according to claim 8, wherein the quinoline acid is selected from the group consisting of: 8-quinolineboronic acid, 2-methyl-6-quinolinecarboxylic acid, quinoline-4-carboxylic acid, 6-quinolinecarboxylic acid, 8-quinolinecarboxylic acid, 3-quinolinecarboxylic acid, 2-chloroquinoline-4-carboxylic acid, 3-quinolineboronic acid, quinaldic acid, 5-isoquinolinesulfonic acid, quinoline-8-sulfonic acid, isoquinoline-1-carboxylic acid, 2-chloro-3-quinolinecarboxylic acid, 7-quinolinecarboxylic acid, quinoline-2,4-dicarboxylic acid and 2-methyl-quinoline-4-carboxylic acid.

14. A photoreceptor comprising:

a conductive substrate;

an undercoat layer disposed on the conductive substrate, the undercoat layer including a binder resin, metal oxide particles, and a compound selected from the group consisting of: a hydroxyquinoline, an aminoquinoline and a quinoline acid;

a photosensitive layer disposed on the undercoat layer; and an anti-curl backing layer disposed on a surface of a substrate opposite to that bearing the photosensitive layer.

15. The photoreceptor according to claim 14, further comprising an overcoat layer disposed on the photosensitive layer.

16. The photoreceptor according to claim 14, wherein the hydroxyquinoline is selected from the group consisting of: 8-hydroxyquinoline, 2-hydroxy-4-methylquinoline, isocarbostyril, 8-hydroxyquinoline-5-sulfonic acid, 8-(trifluoromethyl)quinolin-4-ol, 3-hydroxyisoquinoline, 4-hydroxyquinoline, 3-hydroxy-2-methyl-4-quinolinecarboxylic acid, 2-hydroxy-4-quinolincarboxylic acid, 4-hydroxy-6,7-dimethoxyqunioline, 5,7-dichloro-8-hydroxyquinaldine, 6-bromo-4-hydroxyquinoline, 7-methoxy-4-quinolinol, 5-hydroxyquinoline, 2,6-dihydroxyquinoline, 8-fluoro-4-hydroxyquinoline, 7-hydroxyisoquinoline, 8-hydroxyquinaldine, 2,3-dihydroxyquinoxaline and xanthurenic acid.

17. The photoreceptor according to claim 14, wherein the aminoquinoline is selected from the group consisting of: quinolin-2-amine, 8-aminoisoquinoline, 6-aminoquinoxaline, 8-aminoquinaldine, 2-hydrazinoquinoline, 4-amino-2-methylquinoline, 8-aminoquinoline, 5-aminoquinoline, 6-aminoquinoline, 3-aminoquinoline, 4-aminoguinoline, 1-aminoisoquinoline and 6-amino-2-methylquinoline.

18. The photoreceptor according to claim 14, wherein the quinoline acid is selected from the group consisting of: 8-quinolineboronic acid, 2-methyl-6-quinolinecarboxylic acid, quinoline-4-carboxylic acid, 6-quinolinecarboxylic acid, 8-quinolinecarboxylic acid, 3-quinolinecarboxylic acid, 2-chloroquinoline-4-carboxylic acid, 3-quinolineboronic acid, quinaldic acid, 5-isoquinolinesulfonic acid, quinoline-8-sulfonic acid, isoquinoline-1-carboxylic acid, 2-chloro-3-quinolinecarboxylic acid, 7-quinolinecarboxylic acid, quinoline-2,4-dicarboxylic acid and 2-methyl-quinoline-4-carboxylic acid.

19. The photoreceptor according to claim 14, wherein the metal oxide particles are selected from the group consisting of: tin oxide particles, titanium oxide particles, zinc oxide particles, and zirconium oxide particles.

20. The photoreceptor according to claim 14, wherein the photosensitive layer comprises a charge generation layer; and a charge transport layer.

* * * * *